US011660507B2

(12) United States Patent
Kim et al.

(10) Patent No.: US 11,660,507 B2
(45) Date of Patent: May 30, 2023

(54) SPORTS BALL WITH WICKERBILL

(71) Applicant: NIKE, Inc., Beaverton, OR (US)

(72) Inventors: George S. Kim, Wilsonville, OR (US); Arthur Parker Molinari, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 16/885,216

(22) Filed: May 27, 2020

(65) Prior Publication Data

US 2021/0001185 A1 Jan. 7, 2021

Related U.S. Application Data

(60) Provisional application No. 62/870,419, filed on Jul. 3, 2019.

(51) Int. Cl.
*A63B 41/08* (2006.01)
*A63B 45/00* (2006.01)

(52) U.S. Cl.
CPC ..... *A63B 41/08* (2013.01); *A63B 45/00* (2013.01); *A63B 2209/00* (2013.01); *A63B 2243/0025* (2013.01)

(58) Field of Classification Search
CPC ..... A63B 41/08; A63B 45/00; A63B 2209/00; A63B 2243/0025
See application file for complete search history.

(56) References Cited

U.S. PATENT DOCUMENTS 2,182,052 A 12/1939 Reach
2,448,731 A * 9/1948 Park ..... A63B 43/00 473/596

(Continued)

FOREIGN PATENT DOCUMENTS

EP 2044980 A1 4/2009
GB 2447845 A 10/2008

OTHER PUBLICATIONS

Adrian L. Kiratidis and Derek B. Leinweber, An Aerodynamic Analysis of Recent FIFA World Cup Balls, Special Research Centre for the Subatomic Structure of Matter, Department of Physics, The University of Adelaide, SA, 5005, Australia, Feb. 20, 2018.

(Continued)

*Primary Examiner* — Steven B Wong
(74) *Attorney, Agent, or Firm* — Quinn IP Law

(57) ABSTRACT

A sports ball comprising a cover disposed about a bladder is provided. The cover comprises an outer substrate and defines an outer substrate surface and a feature surface. The outer substrate surface defines a plurality of plateau sections. The feature surface is radially spaced apart from the outer substrate surface and further defines a plurality of indentations and a plurality of protrusions. Each indentation has an indentation terminus disposed on the feature surface and radially spaced apart from the outer substrate surface by an indentation depth. The protrusions are positioned on the plateau sections, and each protrusion has a protrusion terminus disposed on the feature surface and radially spaced apart from the outer substrate surface by a protrusion height. At least one protrusion is positioned less than a predetermined distance of about 1.0 millimeters from at least one of the indentations, thereby acting as a wickerbill on the ball.

18 Claims, 7 Drawing Sheets

(56) References Cited

U.S. PATENT DOCUMENTS 2,494,806 A * 1/1950 Gibson ..... A63B 41/08 473/596
2,931,653 A * 4/1960 Gow ..... A63B 41/08 473/596
3,256,019 A * 6/1966 Barton ..... A63B 37/0097 473/597
3,512,777 A * 5/1970 Henderson ..... A63B 41/08 473/597
4,318,544 A 3/1982 Brine, Jr.
4,337,944 A 7/1982 Massino
4,542,902 A 9/1985 Massino
4,570,931 A * 2/1986 Martin ..... A63B 39/06 473/596
4,736,948 A 4/1988 Thomas
4,928,962 A 5/1990 Finley
4,991,842 A 2/1991 Finley
5,354,053 A 10/1994 Ratner et al.
5,427,372 A * 6/1995 Ratner ..... A63B 41/08 156/147
5,451,046 A 9/1995 Batton
5,518,234 A 5/1996 Palmquist
5,683,316 A 11/1997 Campbell
5,735,761 A 4/1998 Palmquist
5,851,161 A 12/1998 Sassak
5,984,812 A * 11/1999 Sassak ..... A63B 41/08 473/596
6,012,997 A 1/2000 Mason
6,123,633 A * 9/2000 Guenther ..... A63B 41/08 473/604
6,283,881 B1 * 9/2001 Feeney ..... A63B 41/08 473/596
6,302,815 B1 10/2001 Shishido et al.
RE37,468 E * 12/2001 Kennedy ..... A63B 41/08 473/596
6,503,162 B1 1/2003 Shishido et al.
6,520,877 B1 * 2/2003 Yang ..... A63B 41/08 473/597
6,592,477 B1 * 7/2003 Yang ..... A63B 37/14 473/597
6,612,948 B1 * 9/2003 Miller ..... A63B 41/08 473/596
6,685,584 B2 * 2/2004 Jin ..... A63B 37/14 473/596
6,685,585 B2 2/2004 Shishido et al.
6,988,969 B2 1/2006 Avis
7,300,357 B2 11/2007 Breaker et al.
7,614,959 B1 11/2009 Gentile
7,654,880 B2 2/2010 Schneider
7,854,671 B2 12/2010 Lalvani
8,002,652 B2 8/2011 Wong
8,182,379 B2 5/2012 Rapaport et al.
8,216,098 B2 7/2012 Lalvani
8,262,519 B2 9/2012 Raynak et al.
8,371,971 B2 2/2013 Bevier
8,529,386 B2 9/2013 Nuernberg et al.
8,579,743 B2 11/2013 Cohen et al.
8,597,144 B2 12/2013 Chang et al.
8,608,599 B2 12/2013 Raynak et al.
8,617,011 B2 12/2013 Berggren et al.
8,672,783 B2 3/2014 Fujikura et al.
8,684,870 B2 4/2014 Ito et al.
8,708,847 B2 4/2014 Berggren et al.
8,777,787 B2 7/2014 Raynak et al.
8,845,466 B2 9/2014 Bevier
8,852,039 B2 10/2014 White et al.
8,926,459 B2 1/2015 Berggren et al.
8,974,330 B2 3/2015 Berggren et al.
9,254,424 B2 2/2016 Berggren et al.
9,272,190 B2 3/2016 Tompkins
9,327,167 B2 5/2016 Raynak et al.
9,370,693 B2 6/2016 Berggren et al.
9,370,695 B2 6/2016 Chang et al.
9,452,322 B2 9/2016 Thurman et al.
9,457,239 B2 10/2016 White et al.
9,457,525 B2 10/2016 Berggren et al.
9,468,815 B2 10/2016 Berggren et al.
9,486,675 B1 11/2016 White
9,504,880 B2 11/2016 Bevier
9,539,473 B2 1/2017 Berggren et al.
9,694,247 B2 7/2017 Nurnberg
9,814,941 B2 11/2017 Cohen et al.
9,821,195 B2 11/2017 Raynak et al.
9,855,469 B2 1/2018 Berggren et al.
9,884,227 B2 2/2018 Berggren et al.
9,919,483 B2 3/2018 Nurnberg
10,016,935 B2 7/2018 Berggren et al.
10,207,158 B2 2/2019 Berggren et al.
10,258,836 B2 4/2019 Molinari
10,583,331 B2 * 3/2020 Wakibayashi ..... A63B 41/08
11,097,164 B2 * 8/2021 Krysiak ..... A63B 41/08
2004/0142780 A1 7/2004 Estefano
2004/0259670 A1 12/2004 Chang
2006/0046879 A1 * 3/2006 Kelly ..... A63B 41/08 473/603
2006/0105866 A1 5/2006 Ma
2006/0205544 A1 9/2006 Wyner et al.
2007/0049432 A1 * 3/2007 Junior ..... A63B 41/08 473/596
2007/0117662 A1 5/2007 Ma
2008/0287218 A1 11/2008 Freund
2008/0305900 A1 * 12/2008 Geisendorfer ..... A63B 41/08 473/596
2009/0042659 A1 2/2009 Breaker et al.
2009/0325742 A1 12/2009 Krysiak
2011/0012309 A1 1/2011 Schreff
2011/0152018 A1 6/2011 Walling et al.
2011/0250819 A1 10/2011 Tashman
2011/0250997 A1 10/2011 Walling et al.
2013/0260927 A1 10/2013 Thurman et al.
2014/0038741 A1 2/2014 Brooks
2014/0100067 A1 * 4/2014 Swiszcz ..... B29C 59/02 473/603
2014/0179468 A1 6/2014 Berggren et al.
2015/0045159 A1 * 2/2015 Tompkins ..... A63B 45/00 473/596
2015/0367183 A1 12/2015 Ou
2016/0082323 A1 3/2016 Higa et al.
2016/0089580 A1 3/2016 Nurnberg
2016/0243408 A1 8/2016 Tompkins
2016/0263444 A1 9/2016 Nurnberg
2016/0288438 A1 10/2016 Chang et al.
2016/0346627 A1 12/2016 Le et al.
2016/0346964 A1 12/2016 Nurnberg et al.
2017/0050089 A1 2/2017 Olivares Velasco
2017/0246512 A1 8/2017 Berggren et al.
2017/0291076 A1 10/2017 Campbell
2017/0354851 A1 12/2017 Lyon
2018/0078827 A1 3/2018 Berggren et al.
2018/0111024 A1 4/2018 Ou
2018/0133562 A1 5/2018 Berggren et al.
2018/0154220 A1 6/2018 Campbell
2018/0161636 A1 6/2018 Ahmed
2018/0169483 A1 6/2018 Ou
2018/0200969 A1 7/2018 Nurnberg
2018/0243614 A1 * 8/2018 Berggren ..... A63B 45/00
2018/0243615 A1 * 8/2018 Berggren ..... A63B 41/08
2019/0083859 A1 3/2019 Berggren et al.
2019/0184242 A1 6/2019 Molinari
2020/0206581 A1 * 7/2020 Krysiak ..... A63B 41/02
2020/0230468 A1 * 7/2020 Molinari ..... A63B 41/08

OTHER PUBLICATIONS

F. Alam, H. Chowdhury, B. Loganathan, I. Mustary and S. Watkins, Aerodynamic Drag of Contemporary Soccer Balls, 19th Australasian Fluid Mechanics Conference, Melbourne, Australia, Dec. 2014.

Firoz Alam, Harun Chowdhury, Mark Stemmer, Zilong Wang and Jie Yang, Effects of surface structure on soccer ball aerodynamics, Procedia Engineering 34 (2012) pp. 146-151, Published by Elsevier Ltd.

(56) References Cited

OTHER PUBLICATIONS

John Eric Goff, Matt J. Carre, Investigations into soccer aerodynamics via trajectory analysis and dust experiments, Procedia Engineering 34 (2012) pp. 158-163, Published by Elsevier Ltd.
John Eric Goff, Sungchan Hong and Takeshi Asai, Aerodynamic and surface comparisons between Telstar 18 and Brazuca, Journal of Sports Engineering and Technology, 2018, pp. 1-7, DOI: 10.1177/1754337118773214.
Luca Oggiano, Lars Saetran, Aerodynamics of modern soccer balls, Procedia Engineering 2 (2010) pp. 2473-2479, Published by Elsevier Ltd.
Pouya Jalilian, Patrick K. Kreun, Mohammadhady M. Makhmalbaf and William W. Liou, Computational Aerodynamics of Baseball, Soccer Ball and Volleyball, American Journal of Sports Science, vol. 2, No. 5, 2014, pp. 115-121, doi: 10.11648/j.ajss.20140205.12.
Sungchan Hong and Takeshi Asai, Aerodynamic effects of dimples on soccer ball surfaces, Heliyon 3 (2017) e00432, doi: 10.1016/j.heliyon.2017.e00432.
Sungchan Hong and Takeshi Asai, Effect of panel shape of soccer ball on its flight characteristics, Sci. Rep. 4, 5068; DOI:10.1038/srep05068 (2014).
T. Asai, K. Seo, O. Kobayashi and R. Sakashita, Fundamental aerodynamics of the soccer ball, Sports Engineering (2007) 10, pp. 101-110.
Takeshi Asai, Kazuya Seo, Aerodynamic drag of modern soccer balls, SpringerPlus 2013, 2:171, Published Apr. 19, 2013.

* cited by examiner

SPORTS BALL WITH WICKERBILL

CROSS-REFERENCE TO RELATED APPLICATIONS

This application claims the benefit of U.S. Provisional Application No. 62/870,419, filed Jul. 3, 2019, which is hereby incorporated by reference in its entirety.

TECHNICAL FIELD

The disclosure relates to inflatable sports balls.

BACKGROUND

A variety of inflatable sport balls, such as a soccer ball, conventionally exhibit a layered structure that includes a casing, an intermediate structure, and a bladder. The casing forms an exterior portion of the sports ball and is generally formed from a plurality of durable and wear-resistant panels joined together along abutting edge areas (e.g., with stitching, adhesives, or bonding), i.e., via a seam. Designs such as decorative elements and holistic textural patterns may be applied to the exterior surface of the casing. Decorative elements are conventionally applied via processes such as thermal transfer films or a release paper. Textural patterns are conventionally applied via processes such as embossing, debossing, stamping, molding, or laser etching.

The intermediate structure forms a middle portion of the sports ball and is positioned between the casing and the interior. Among other purposes, the intermediate structure may provide a softened feel to the sport ball, impart energy return, and restrict expansion of the bladder. In some configurations, the intermediate structure or portions of the intermediate structure may be bonded, joined, or otherwise incorporated into the casing as a backing material. In other configurations, the intermediate structure or portions of the intermediate structure may be bonded, joined, or otherwise incorporated into the interior.

SUMMARY

A sports ball is provided. The sports ball may include an interior bladder and a cover disposed about the interior bladder. The cover may comprise a plurality of adjoining panels. The plurality of panels may collectively form an outer substrate, which defines an outer substrate surface. The outer substrate surface may define a plurality of plateau sections.

The cover may further define a feature surface radially spaced apart from the outer substrate surface. The feature surface may define a plurality of indentations positioned between the plateau sections. Each indentation comprises a first shoulder portion positioned at a first boundary, a second shoulder portion positioned at a second boundary, an indentation width disposed between the first boundary and the second boundary, and an indentation terminus disposed on the feature surface and radially spaced apart from the outer substrate surface by an indentation depth.

The feature surface may further define a plurality of protrusions disposed on the plateau sections. Each protrusion extends from the outer substrate surface to a protrusion terminus disposed on the feature surface and radially spaced apart from the outer substrate surface by a protrusion height. At least one of the protrusions is disposed a predetermined distance from at least one of the first boundary or the second boundary of a respective indentation.

DETAILED DESCRIPTION

Figure 1:
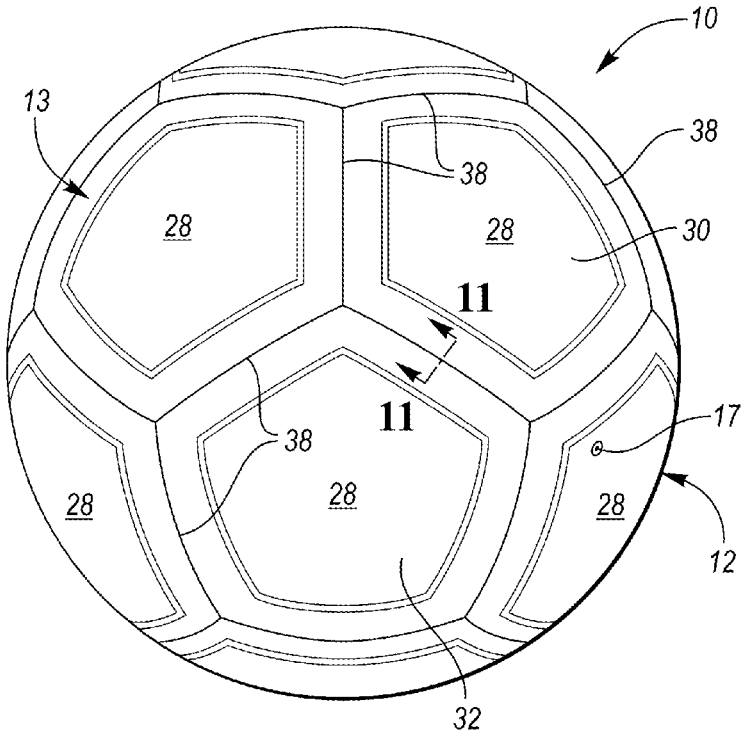
FIG. 1 is a schematic perspective view of an example inflatable sports ball.

While the present disclosure may be described with respect to specific applications or industries, those skilled in the art will recognize the broader applicability of the disclosure. Those having ordinary skill in the art will recognize that terms such as "above," "below," "upward," "downward," etc., are used descriptively of the figures, and do not represent limitations on the scope of the disclosure, as defined by the appended claims. Any numerical designations, such as "first" or "second" are illustrative only and are not intended to limit the scope of the disclosure in any way.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

The terms "a," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

Features shown in one figure may be combined with, substituted for, or modified by, features shown in any of the figures. Unless stated otherwise, no features, elements, or limitations are mutually exclusive of any other features, elements, or limitations. Furthermore, no features, elements, or limitations are absolutely required for operation. Any specific configurations shown in the figures are illustrative only and the specific configurations shown are not limiting of the claims or the description.

The following discussion and accompanying figures disclose various sports ball configurations and methods relating to manufacturing of the sport balls. Although the sports ball is depicted as a soccer ball in the associated Figures, concepts associated with the configurations and methods may be applied to various types of inflatable sport balls, such as basketballs, footballs (for either American football or rugby), volleyballs, water polo balls, etc. and variety of non-inflatable sports balls, such as baseballs and softballs, may also incorporate concepts discussed herein.

Referring to the drawings, wherein like reference numerals refer to like components throughout the several views, a sports ball 10 is provided. In a general sense, the sports ball 10 of the present disclosure includes a plurality of outer panels 28 that each have a surface texture 45 formed thereon comprising a plurality of indentations 34 positioned between a plurality of plateau sections 35, and a plurality of protrusions 23 additively applied to the plateau sections 35 near the adjacent indentations 34. The protrusions 23 are disposed upon the respective plateau section 35 as close to the adjacent indentation 34 as possible, to allow the respective protrusion 23 to function as a small tab-like structure projecting from the trailing edge or shoulder portion 29*a*, 29*b* of the adjacent indentation 34. For example, the protrusion 23 may act as a wickerbill on the ball 10, such that, in flight, the protrusion 23 operates to trip the boundary layer of air surrounding the ball 10 from laminar to turbulent flow just before the air flows into the respective indentation 34. This forced alteration of the airflow around the ball 10 from laminar flow to turbulent flow at a predetermined point promotes stability and consistency of the ball 10 during flight.

Figure 2:
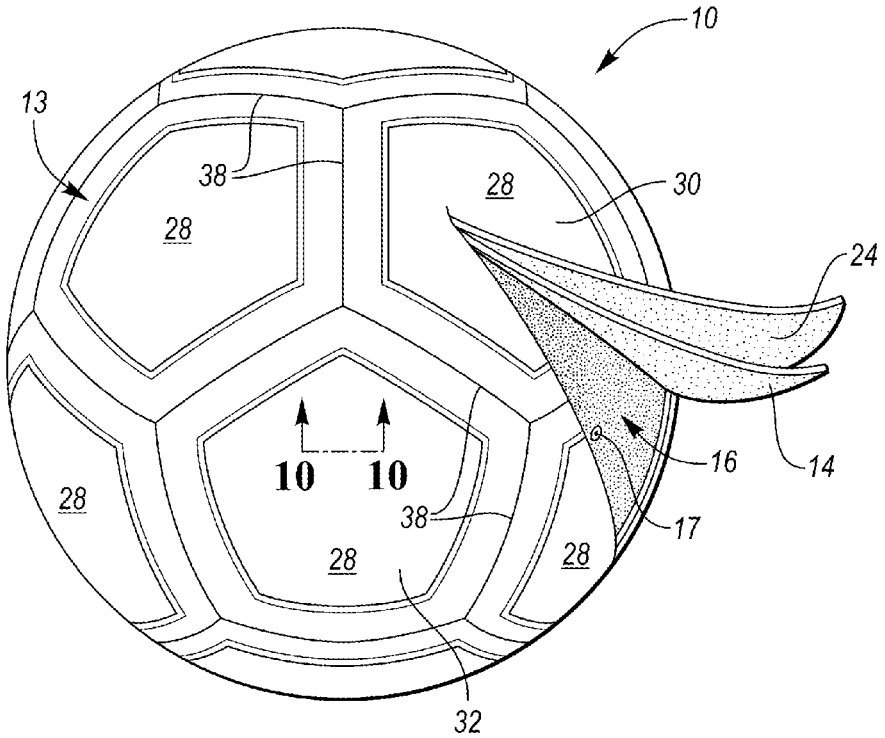
FIG. 2 is a schematic perspective view of an example inflatable sports ball, wherein the ball includes an interior bladder and a cover, the cover including an outer substrate layer and an intermediate structure.

As shown in FIGS. 1-3 and 6, the sports ball 10 may be an inflatable sports ball such as a soccer ball or the like or a non-inflatable sports ball 10 such as a softball or the like. A sports ball 10 having the general configuration of a soccer ball is depicted in FIGS. 1-3 and 6. As shown in FIGS. 1 and 2, the sports ball 10 may have a layered structure including a cover 12 and an interior 16 (FIGS. 2 and 8-11). The cover 12 forms an exterior portion of the sports ball 10. The interior 16 forms an interior portion of sports ball 10. The sports ball 10 may also include an intermediate structure 14 located interior to the cover 12 between the cover 12 and the interior 16.

In a non-inflatable example configuration of the sports ball 10, the interior 16 may be one of a solid mass or a hollow mass, fixed in size. In an inflatable example configuration of the sports ball 10, the interior 16 may be an interior bladder (FIGS. 2 and 8-11). In the inflatable example configuration, in order to facilitate inflation (i.e., fill the interior with pressurized air) to a predetermined internal pressure, the interior 16 generally includes a valved opening 17 that extends through the cover 12, thereby being accessible from the exterior surface 13 of the sports ball 10. Upon inflation, the bladder 16 is pressurized and the pressurization induces the exterior surface 13 to be a substantially spherical surface as the sports ball 10 takes on a substantially spherical shape. More particularly, pressure within the bladder 16 causes the bladder 16 to place an outward force upon the cover 12 on an inner substrate surface 20.

The cover 12 forms an exterior portion of the sports ball 10. The term cover 12 is meant to include any layer of the sports ball 10 that surrounds the interior 16. Thus, the cover 12 has a thickness 88 and may include both the outer substrate layer 24, i.e., the outermost layer as well as any intermediate cover layers 22, 26, which are disposed between the interior 16 and the exterior surface 13. As shown in FIGS. 2 and 8-11, the cover 12 may be composed as a layered structure including the outer substrate layer 24 and an intermediate structure 14 located interior to the outer substrate layer 24 between the outer substrate layer 24 and the interior 16. The cover 12 further includes the outer substrate surface 18, defined by the outer substrate 24, the inner substrate surface 20 opposite the outer substrate surface 18, and a feature surface 21 radially spaced apart from the outer substrate surface 18. The outer substrate surface 18 and the feature surface 21 cooperate to define the exterior surface 13 of the sports ball 10. The inner substrate surface 20 is disposed opposite the outer substrate surface 18 and the feature surface 21, and may be disposed adjacent to the ball interior 16.

In some embodiments, the outer substrate layer 24 may be a composed of a polymeric material, a polymer foam material, or the like. Examples of suitable polymer materials include, but are not limited to, polyurethane, polyvinylchloride, polyamide, polyester, polypropylene, polyolefin, and the like.

The intermediate structure 14 may include a first intermediate cover layer 26 and a second intermediate cover layer 22. The first intermediate cover layer 26 is positioned between the outer substrate layer 24 and the second intermediate cover layer 22. The second intermediate cover layer 22 is positioned between the first intermediate cover layer 26 and the interior bladder 16. The second intermediate cover layer 22 may include the inner substrate surface 20, wherein the inner substrate surface 20 is positioned adjacent to the ball interior 16.

The respective intermediate cover layers 22, 26 of the intermediate structure 14 may be composed of a polymeric material, a polymer foam material, a foam material, textiles, or the like. Examples of suitable polymer materials include, but are not limited to, polyurethane, polyvinylchloride, polyamide, polyester, polypropylene, polyolefin, and the like. Examples of suitable polymer foam materials include, but are not limited to, polyurethane, ethylvinylacetate, and the like. Examples of suitable textile materials include, but are not limited to, a woven or knit textile formed from polyester, cotton, nylon, rayon, silk, spandex, or a variety of other materials. A textile material may also include multiple materials, such as a polyester and cotton blend. The intermediate structure 14 may further provide a softened feel to the sports ball, impart energy return, and restrict expansion of the bladder 16, in an inflatable sports ball 10 example. In one example, the outer substrate layer 24 may be formed a thermoplastic polyurethane material (TPU), first intermediate cover layer 26 may be formed from a polymer foam material, the second intermediate cover layer 22 may be formed from one of a polymeric material, a polymer foam material, a foam material, or a textile material.

Figure 10:
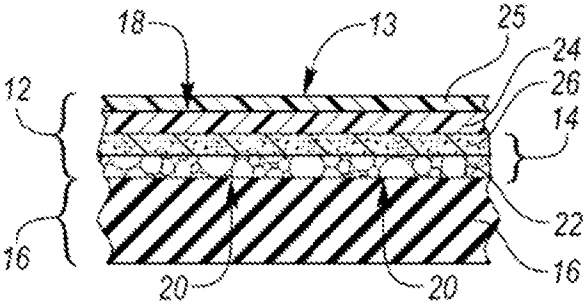
FIG. 10 is an enlarged, schematic, example cross-section of the cover shown in FIG. 2, taken along line 10-10.

As shown in FIG. 10, the cover may further include an external surface layer 25 disposed upon the outer substrate surface 18 and feature surface 21 of the cover 12. The external surface layer 25 may be a film that includes a pigment or a graphic thereon. The external surface layer 25 may also be an outer film or clear coat having weather-resistant properties. The external surface layer 25 may be a polyurethane film or the like. The external surface layer 25 may be bonded to the outer substrate surface 18 and feature surface 21 via a bonding material.

As shown in FIGS. 1-7, the cover 12 may be generally formed by a plurality of adjoining panels 28, wherein each panel 28 has a respective panel surface that defines a portion of the outer substrate surface 18. The plurality of panels 28 includes at least a first panel 30 having a first panel surface and a second panel 32 having a second panel surface. The plurality of panels 28 may comprise the conventional twelve (12) panels or any other number of panels 28, for example, four joined panels 28 each having nine edges 36 and having a generally triangular shape that is formed from three pentagons, such as the panel 28 illustrated in FIG. 4. The cover 12 may also exhibit a substantially-uniform or unbroken configuration that does not include panels 28 joined at abutting edge areas 36 via seams 38, or includes fewer panels 28. In configurations, wherein a reduced number of panels 28 are present, or the ball 10 exhibits a substantially uniform or unbroken configuration, indentations 34 or pseudo seams in the cover 12 may be positioned to impart the appearance of panels 28. Each panel 28 may have a panel center 37 and a panel limit 39, wherein the panel limit 39 runs adjacent the respective abutting edge area 36.

Figure 11:
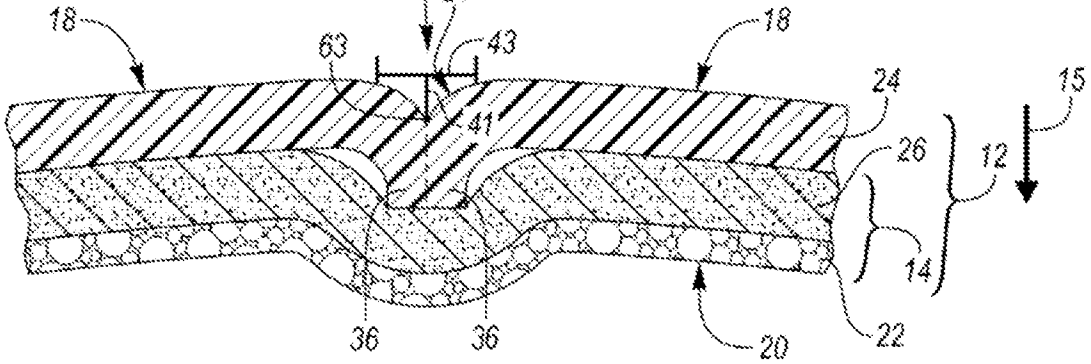
FIG. 11 is an enlarged, schematic, example cross-section of a seam coupling two adjoining panels, as shown in FIG. 1, taken along line 11-11.

As shown in FIG. 11, each seam 38 may have a seam terminus 63 positioned on the feature surface 21 and radially-spaced apart from the outer substrate surface 18 in a first direction 15 toward the inner substrate surface 20. Further, each seam 38 may have a seam depth 41 and a seam width 43. The seam terminus 63 is positioned on the feature surface 21 and radially-spaced apart from the outer substrate surface 18 by the seam depth 41.

The panels 28 may be coupled along the abutting edge areas 36 (FIG. 4) by the seams 38. The panels 28 may be coupled along the abutting edge areas 36 by the seams 38 with stitching, bonding, welding, adhesives, or another suitable coupling method. As utilized herein, the term "welding" or variants thereof (such as "thermal bonding") is defined as a technique for securing two elements to one another that involves a softening or melting of a polymer material within at least one of the elements such that the materials of the elements are secured to each other when cooled. Similarly, the term "weld" or variants thereof (e.g., "thermal bond") is defined as the bond, link, or structure that joins two elements through a process that involves a softening or melting of a polymer material within at least one of the elements such that the materials of the elements are secured to each other when cooled. An example of welded seams 38 is disclosed in U.S. Pat. No. 8,608,599 to Raynak, et al., which is hereby entirely incorporated herein by reference. U.S. Pat. No. 8,608,599 to Raynak, et al. generally discloses examples of welded seams, in that welding generally produces a heat affected zone in which the materials of the two joined components are intermingled. This heat affected zone may be considered a "weld" or "thermal bond." Further, welding may involve (a) the melting or softening of two panels that include polymer materials such that the polymer materials from each panel intermingle with each other (e.g., diffuse across a boundary layer between the polymer materials) and are secured together when cooled, as well as (b) the melting or softening a polymer material in a first panel such that the polymer material extends into or infiltrates the structure of a second panel (e.g., infiltrates crevices or cavities formed in the second panel or extends around or bonds with filaments or fibers in the second panel) to secure the panels together when cooled. Further, welding may occur when only one panel includes a polymer material or when both panels include polymer materials.

As shown in FIGS. 3-12G, the outer substrate surface 18 and the feature surface 21 may cooperate to define the exterior surface 13 of the sports ball 10. The outer substrate surface 18 and the feature surface 21 may collectively define a plurality of topographical features such as seams 38, protrusions 23, indentations 34, plateau sections 35, and the like. The outer substrate surface 18 may define a plurality of plateau sections 35. The feature surface 21 may define the seams 38 and a plurality of indentations 34 or debossed features.

The indentations 34 may impart various advantages to ball 10. For example, indentations 34 may enhance the aerodynamics of ball 10, provide a greater amount of consistency or control over ball 10 during play, e.g., during kicking, dribbling, or passing, improve ball feel, and provide for water channeling. Indentations 34 may be formed in the cover 12 via a variety of manufacturing processes including, but not limited to, debossing. Examples of a manufacturing process for forming channels or indentations 34 are disclosed in U.S. Pat. No. 9,370,693 to Berggren, et al., which is hereby entirely incorporated by reference herein. U.S. Pat. No. 9,370,693 to Berggren, et al. generally discloses a variety of manufacturing processes that may be utilized to form debossed features in panels. In one example, one of panels is located on a platen. A press plate is positioned above platen and includes a protrusion having a predetermined shape. The protrusion presses into and heats the areas of panel forming the debossed features. The press plate then moves away from panel to substantially complete the formation of the indentation 34 or debossed feature.

Each indentation 34 may be spaced apart from each of the other indentations 34. Accordingly, each plateau section 35 may be disposed between a plurality of indentations 34, and likewise, each indentation 34 may be positioned between a plurality of plateau sections 35. Said another way, the plurality of plateau sections 35 and the plurality of indentations 34 define an alternating and repeating series of the plateaus section 35 and the indentations 34.

Referring to FIGS. 8-9 and 12A-12G, each of the indentations 34 may have an indentation terminus 65 positioned on the feature surface 21 and radially-spaced apart from the outer substrate surface 18 in the first direction 15 toward the inner substrate surface 20. Further, each of the indentations 34 has an indentation depth 67 and an indentation width 61.

Further each indentation 34 comprises a first boundary 87 and a second boundary 89, such that the indentation width 61 is disposed between the first boundary 87 and the second boundary 89. Each of the first boundary 87 and the second boundary 89 of the respective indentation 34 border plateau sections 35. Each indentation 34 comprises a pair of shoulder portions 29*a*, 29*b*, one shoulder portion 29*a* positioned at the first boundary 87 and the other shoulder portion 29*b* positioned at the second boundary 89. The first boundary 87 and the second boundary 89 are spaced apart by the indentation width 61. The indentation terminus 65 is positioned on the feature surface 21 and radially-spaced apart from the outer substrate surface 18 by the indentation depth 67. In one example, the indentation depth 67 may be greater than about 0.5 millimeters, and more particularly may be from about 0.5 millimeters to about 1.0 millimeters.

Referring to FIGS. 12A-12G, indentations 34 are formed in the cover 12 and extend in the first direction 15 toward the interior 16, such that the indentation terminus 65 is positioned on the feature surface 21. The indentation 34 may include an exterior portion 82 and an interior portion 84. The exterior portion 82 is defined by the feature surface 21 and has the terminus 65 thereon that is radially-spaced apart from the outer substrate surface 18 by the indentation depth 67.

The intermediate structure 14 is positioned between outer substrate layer 24 and the interior bladder 16. The outer substrate layer 24 may be bonded to the intermediate structure 14 at the respective indentation 34. More particularly, the outer substrate layer 24 may be welded directly to the second intermediate cover layer 22 at the indentation terminus 65 of the respective indentation 34 (FIGS. 12A-C and 12E-G), such that the outer substrate layer 24 extends through an entirety of the indentation depth 67 at each of the indentations 34.

Figure 12A:
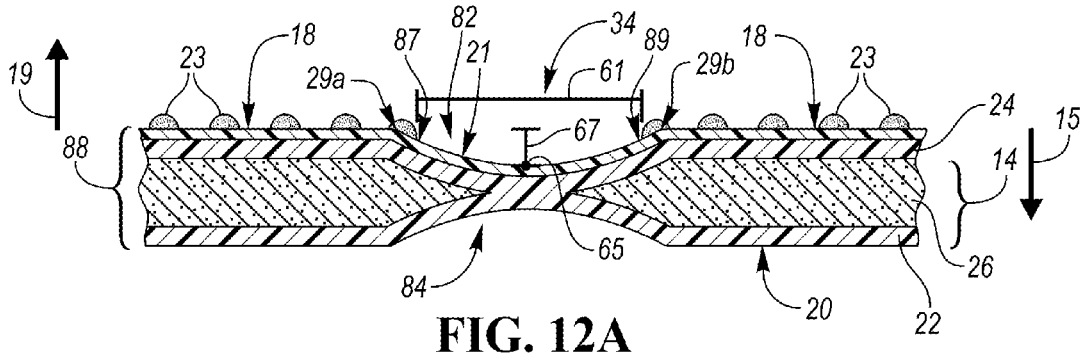
FIG. 12A is an enlarged, schematic, example cross sectional view of an example indentation.
Figure 12B:
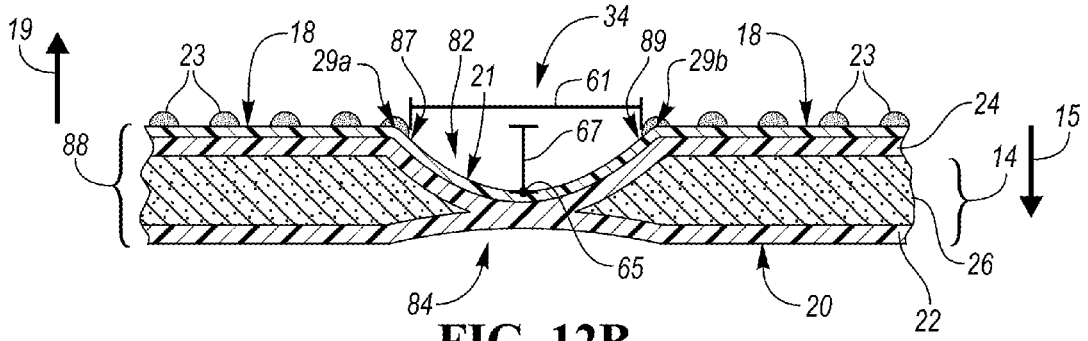
FIG. 12B is an enlarged, schematic, example cross sectional view of an example indentation.
Figure 12C:
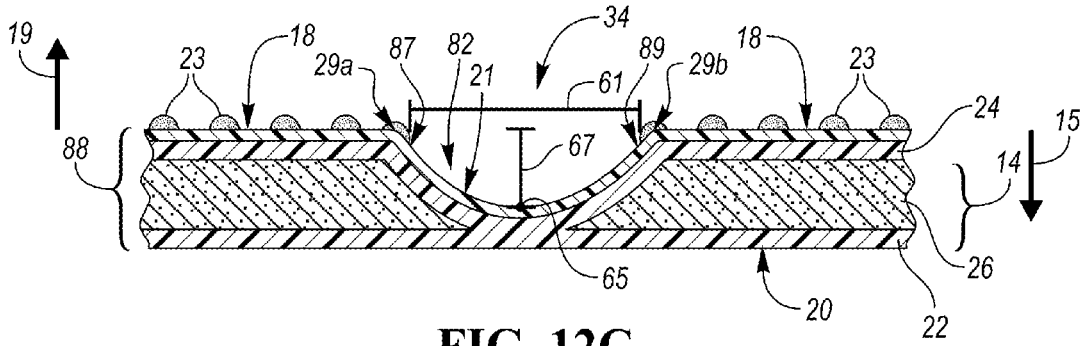
FIG. 12C is an enlarged, schematic, example cross sectional view of an example indentation.

The specific configuration of the indentations 34 may vary considerably. Referring to FIG. 12A-12D, the interior and exterior portions 82 and 84 may have a generally rounded configuration. As depicted in FIG. 12A the interior and exterior portions 82 and 84 extend to an approximate midpoint of the thickness 88 of the panel cross-section. In another configuration, as depicted in FIGS. 12B and 12C, the exterior portion 82 extends through more of the thickness 88 of panel cross section than the interior portion 84. In yet another configuration, as depicted in FIG. 12C, the exterior portion 82 extends through substantially all of the thickness 88 of panel cross-section. As also shown in FIG. 12C, in some embodiments, the second intermediate layer 22 may have a substantially planar configuration opposite the exterior portion 82. Said another way, in some embodiments, the indentation 34 may have only an exterior portion 82 and no interior portion 84.

Figure 12D:
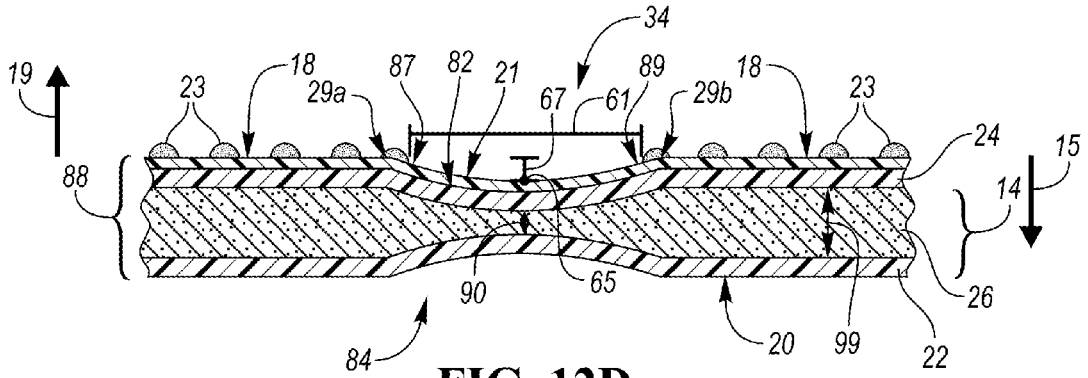
FIG. 12D is an enlarged, schematic, example cross sectional view of an example indentation.

Referring to FIG. 12D, portions 82 and 84, as well as the outer substrate layer 24 and the second intermediate cover layer 22, may be spaced from each other, such that a portion of the first intermediate cover layer 26 extends between portions 82 and 84 and between the outer substrate layer 24 and the second intermediate cover layer 22. In this configuration, the outer substrate layer 24 is bonded to the first intermediate cover layer 26 at the indentation 34. In such an example, the first intermediate cover layer 26 has a first thickness 90 between portions 82 and 84 and at the terminus 65 of the exterior portion 82. In the same example, the first intermediate cover layer 26 has a second thickness 99 between the outer substrate layer 24 and the second intermediate cover layer 22, in an area spaced apart from indentation 34 and the respective portions 82 and 84 and the terminus 65 of the exterior portion 82. As shown in FIG. 12D, the first thickness 90 is less than the second thickness 99.

Figure 12E:
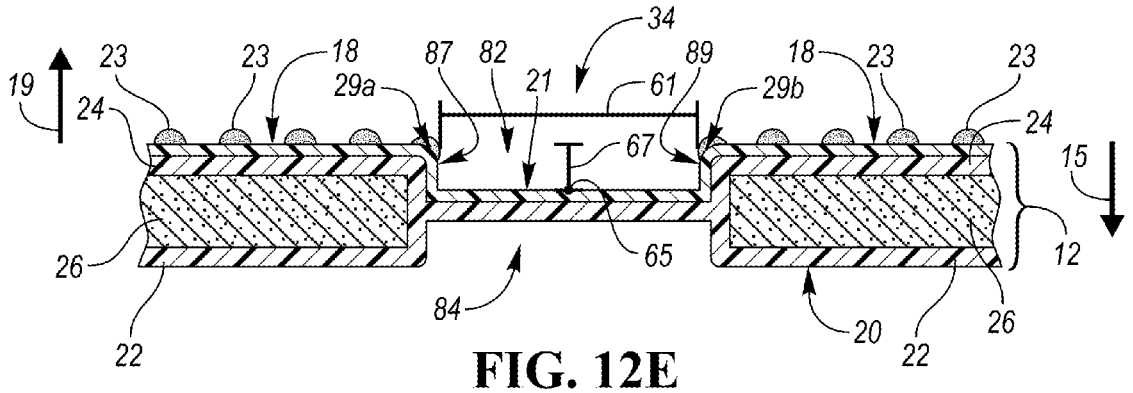
FIG. 12E is an enlarged, schematic, example cross sectional view of an example indentation.
Figure 12F:
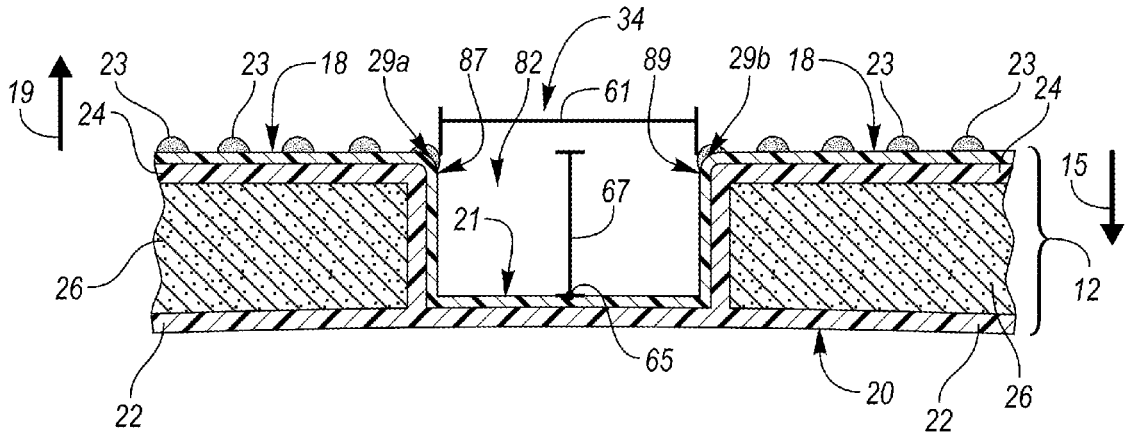
FIG. 12F is an enlarged, schematic, example cross sectional view of an example indentation.
Figure 12G:
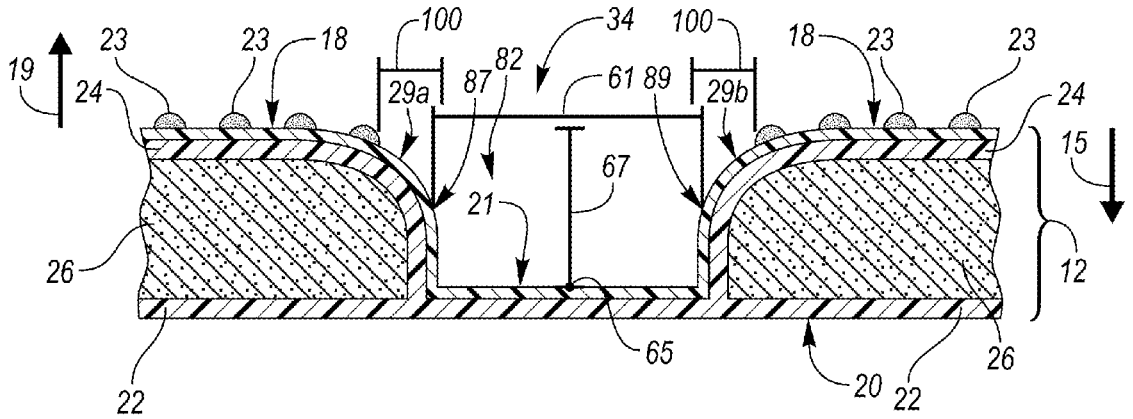
FIG. 12G is an enlarged, schematic, example cross sectional view of an example indentation.

Alternatively, the indentations 34 may include an exterior portion 82 and an interior portion 84 that exhibit substantially squared configurations (FIGS. 12E-12G). For example, in some embodiments, the indentation portions 82, 84 may have substantially squared cross-sectional configurations. Such substantially squared cross-sectional configurations may have a more distinct appearance than indentation portions 82, 84 having substantially rounded cross-sectional configurations. In addition, substantially squared indentation portions 82, 84 may also provide performance benefits such as aerodynamics, ball feel, and water channeling.

As shown in FIG. 12E, the exterior portion 82 and interior portion 84 are two opposing indentations having substantially squared cross-sectional configurations. In FIG. 12E, the indentation portions 82 and 84 extend to an approximate midpoint of the thickness 88 of the panel cross-section, such that the terminus 65 of the exterior portion 82 is positioned radially inward from the exterior surface 13 to the approximate midpoint of the thickness 88 of the panel cross-section.

In FIGS. 12F-12G, the exterior portion 82 may extend through substantially an entirety of the thickness 88 of the panel cross section. As also shown in FIG. 12F-12G, in some embodiments, second intermediate cover layer 22 may have a substantially planar configuration opposite the exterior portion 82. Said another way, in some embodiments, the indentation 34 may have only an exterior portion 82 with and no interior portion 84.

As shown in FIG. 12G, in one example embodiment, the indentation 34 may include substantially-squared exterior portion 82 having a rounded shoulder portion 29*a*, 29*b*. In some embodiments, a substantially-squared shoulder portion 29*a*, 29*b* may have a minimal radius, as shown in FIG. 12F. In another example embodiment, a rounded shoulder portion 29*a*, 29*b* having a larger radius may be used, as shown in FIG. 12G.

In one example, as illustrated in FIGS. 3-9, the plurality of plateau sections 35 may include at least a first plateau section 35*a* and a second plateau section 35*b*. The plurality of indentations 34 may include a first indentation 34*a* and a second indentation 34*b*. The first indentation 34*a* may be disposed between the first plateau section 35*a* and the second plateau section 35*b* and the second indentation 34*b* may be disposed adjacent to the second plateau section 35*b*. In such an example, the first boundary 87 of the first indentation 34*a* is adjacent to the first plateau section 35*a*, the second boundary 89 of the first indentation 34*a* is adjacent to the second plateau section 35*b*, and the first boundary 87 of the second indentation 34*b* is adjacent to the second plateau section 35*b*.

The feature surface 21 may further define a plurality of protrusions 23 disposed on and additively applied to the outer substrate surface 18 at the plateau sections 35. Each of the protrusions 23 may have a protrusion terminus 62 positioned on the feature surface 21 and radially-spaced apart from the outer substrate surface 18 in the second direction 19 away from the inner substrate surface 20 by a protrusion height 64.

In some example embodiments, each of the plurality of protrusions 23 may comprise a dimensional ink. The dimensional ink may be a solvent-based ink, a resin-based ink, a puff ink, a water-based ink, a water-based silicone ink, or the like suitable for additive manufacturing and/or dimensional printing via an additive manufacturing process. The dimensional ink may also include a Polyurethane powder to add texture to the ink. The dimensional ink may also include an organic compound such as Cyclohexanone $(CH_2)_5CO$. The dimensional ink may be clear in color, such that the dimensional ink is transparent or translucent. The dimensional ink may also be pigmented to a predetermined coloration. A mechanoluminescent material may be embedded in the dimensional ink.

More particularly, the dimensional ink may be a hybrid ink containing a polyurethane resin component and a puff ink component. The dimensional ink may also include an organic compound such as Cyclohexanone $(CH_2)_5CO$. The dimensional ink may also be a solvent-based ink containing a polyurethane resin component, an additive component, and an organic compound such as Cyclohexanone $(CH_2)_5CO$; in such examples, the viscosity of the solvent-based ink is from about 150 Decipascal seconds (dPas) to about 600 dPas and the solid content is from about 28% to about 37%.

Figure 8:
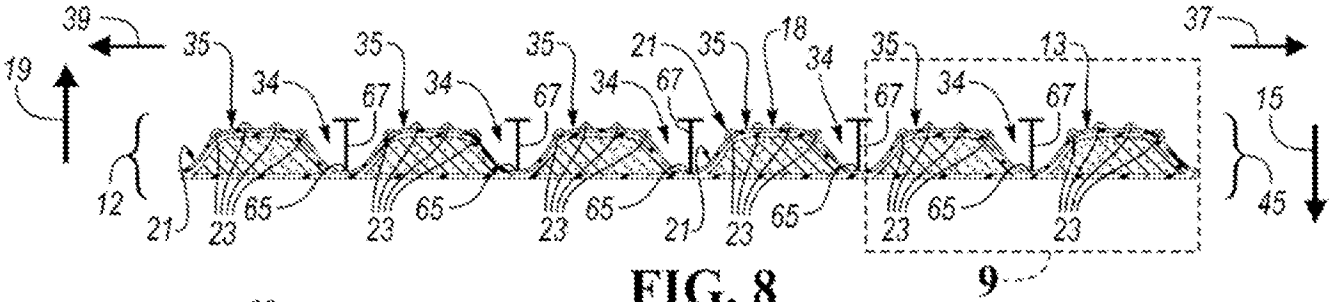
FIG. 8 is an example schematic cross-sectional view of a panel of the type shown in FIG. 4, taken along line 8-8.
Figure 9:
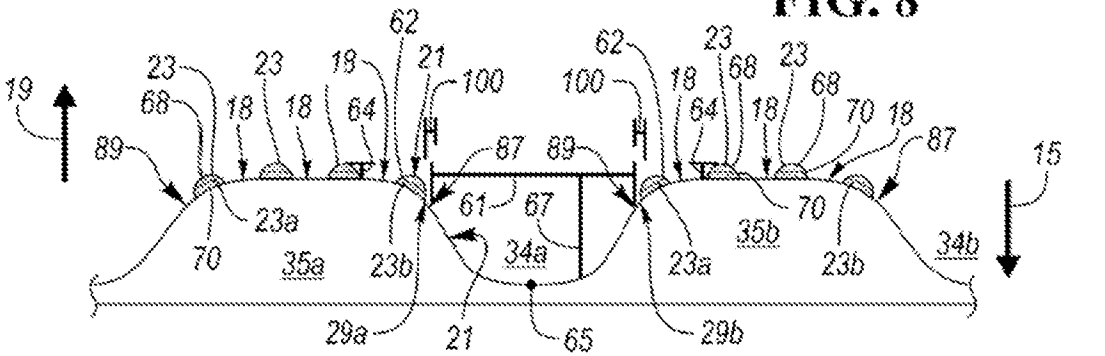
FIG. 9 is an enlarged view of two plateau sections of FIG. 8, wherein the plateau sections have a plurality of protrusions of dimensional ink disposed thereon.

As shown in FIGS. 8-9, each protrusion 23 may be composed of a single layer of dimensional ink that spans the entire protrusion height 64 from the outer substrate surface 18 to the protrusion terminus 62. Each protrusion 23 may, alternatively, be composed of a plurality of layers 68, 70 of dimensional ink, which, together, span the entire height 64 from the outer substrate surface 18 to the protrusion terminus 62. The plurality of layers may include a first layer 68 and a second layer 70. The second layer 70 may be composed of the dimensional ink and may be positioned between the outer substrate surface 18 and the first layer 68. The first layer 68 may be composed of the dimensional ink and may be positioned between the terminus 62 and the second layer 70. In one example embodiment, as shown in FIG. 9, each of the plurality of layers 68, 70 may be composed of a dimensional ink of a particular color different than the remaining layers, the layers may repeat a color pattern, e.g., alternating colors, or the plurality of layers may all be composed of a dimensional ink of the same color, for example a translucent, transparent, or opaque dimensional ink.

As illustrated in FIGS. 3-9, each plateau section 35 may have at least two protrusions 23 disposed thereon. Each of the protrusions 23, defined by the feature surface 21, extend from the outer substrate surface 18. As shown in FIGS. 8-9, each of the plurality of the protrusions 23 has a terminus 62 that is disposed on the feature surface 21 and is radially spaced apart from the outer substrate surface 18 by a protrusion height 64. The protrusions 23*a*, 23*b* may be additively applied to the outer substrate 24 via an additive manufacturing process.

In one example embodiment, the protrusion height 64 may be greater than about 0.05 millimeters. More particularly, the protrusion height 64 may be from about 0.07 millimeters (mm) to about 0.15 millimeters (mm). In such examples, it is beneficial for the height 64 to be at least 0.05 millimeters (mm) and less than 0.15 millimeters (mm) in order to enhance playability of the ball 10. Protrusions 23 having heights 64 in the aforementioned range exhibit the desired grip or contact between a user and/or player's hand or foot and the exterior surface 13 of the ball 10, while still allowing the ball 10 to maintain desired aerodynamic and flight characteristics.

The plurality of protrusions 23 may include at least a first protrusion 23*a* and a second protrusion 23*b*, which are positioned on a respective plateau section 35 such that they extend along and are proximate to a boundary 87, 89 of a respective indentation 34. More particularly, at least one protrusion 23 is positioned a predetermined distance 100 from each boundary 87, 89 of a respective indentation 34.

In one example embodiment, illustrated in FIGS. 3-5, 9, the second protrusion 23*b* positioned on the first plateau section 35*a* is positioned the predetermined distance 100 from the first boundary 87 of the first indentation 34*a*. Further, the first protrusion 23*a* positioned on the second plateau section 35*b* is positioned the predetermined distance 100 from the second boundary 89 of the first indentation 34*a*. Still further, the second protrusion 23*b* positioned on the second plateau section 35*b* is disposed the predetermined distance 100 from the first boundary 87 of the second indentation 34*b*. Said another way, a respective first protrusion 23*a* and second protrusion 23*b* dispose don a respective plateau section 35*a*, 35*b* is placed the predetermined distance 100 from one of the first boundary 87 and the second boundary 89 of a respective indentation 34. More particularly, the first protrusion 23*a* is positioned the predetermined distance 100 from the second boundary 89 and the second protrusion 23*b* is positioned the predetermined distance 100 from the first boundary 87 of each indentation 34. The protrusions 23*a*, 23*b* in essence function as a small tab-like structures projecting from the trailing edge or shoulder portion 29*a*, 29*b* of the respective indentation 34, e.g., the respective protrusions 23*a*, 23*b* may function as wickerbill-like features on the ball 10.

Figure 3:
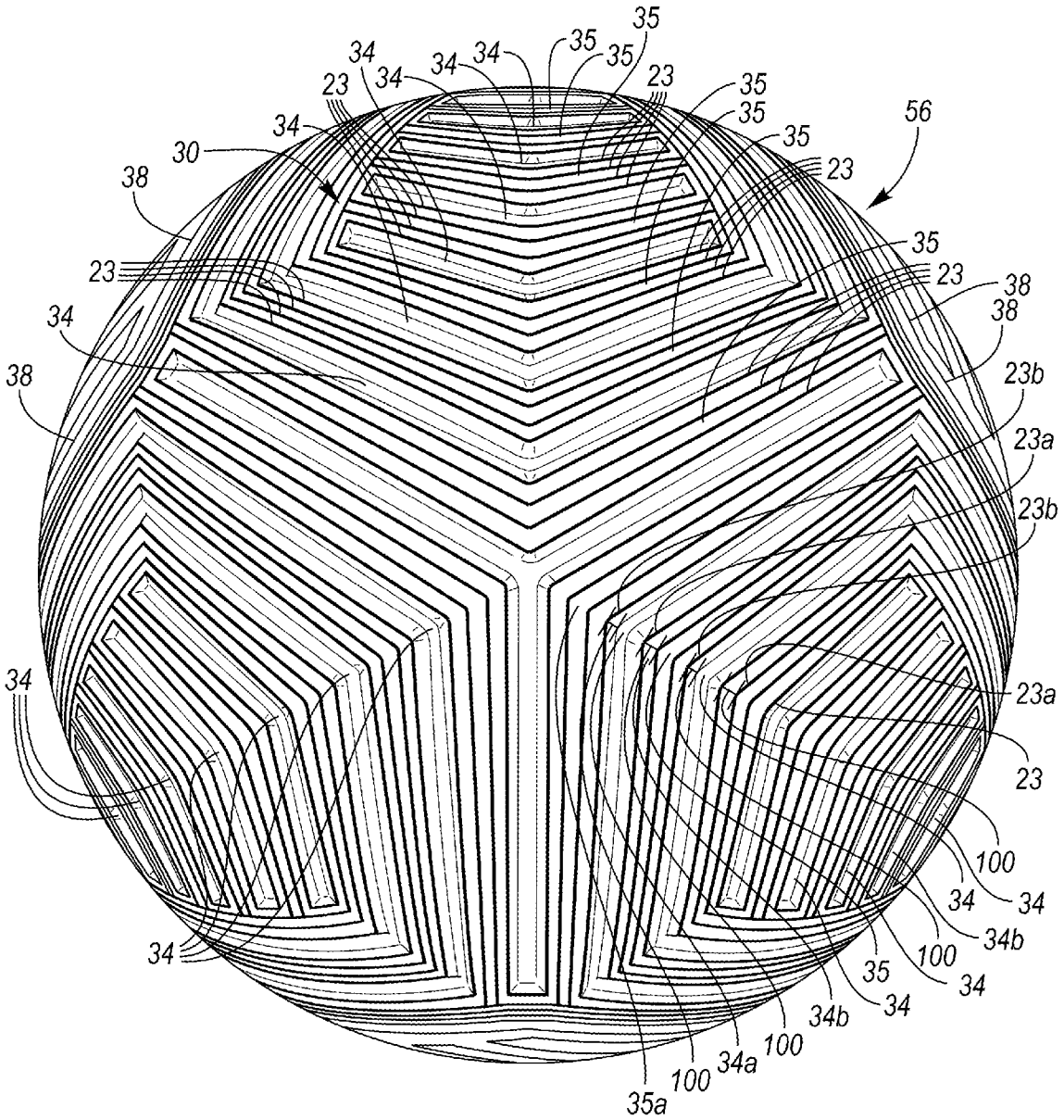
FIG. 3 is a schematic perspective view of one example inflatable sports ball, wherein the cover includes a plurality of indentations, and a plurality of protrusions, which cooperate to define a topographical design on the exterior surface of the inflatable sports ball.
Figure 4:
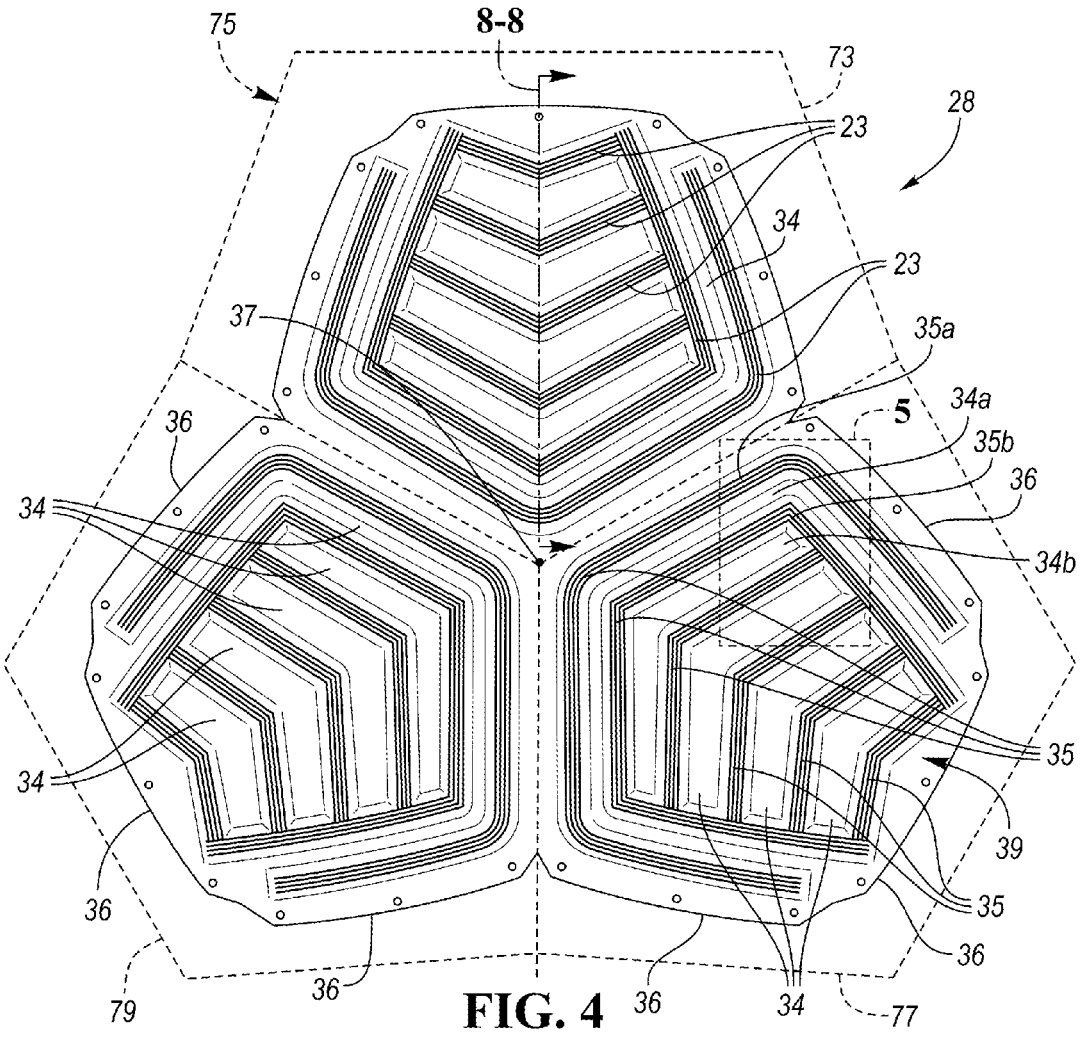
FIG. 4 is a schematic plan view of one example panel of a four-panel sports ball, wherein the example panel has a generally triangular shape that is formed from three pentagon-shaped sub-panels.
Figure 5:
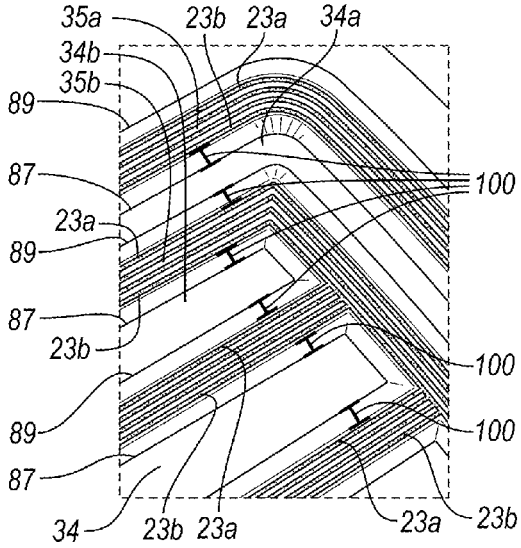
FIG. 5 is an enlarged view of a portion of the example panel shown in FIG. 4.

As shown in FIGS. 3-5, each plateau section 35 may also include additional protrusions 23 that are disposed on the interior portion of the respective plateau section 35 between the first protrusion 23*a* positioned proximate the second boundary 89 and the second protrusion 23*b* positioned proximate the first boundary 87 of the adjacent indentation 34. In the example shown in FIGS. 3-5, each plateau section 35 has at least one additional protrusion 23 positioned between the first protrusion 23*a* and the second protrusion 23*b*. These additional protrusions 23 allow for enhanced playability of the ball 10 in that these protrusions 23 promote wet traction of the ball 10 with the surface of play, as well as desired grip or contact between a user and/or player's hand or foot and the exterior surface of the ball 10.

Figure 7:
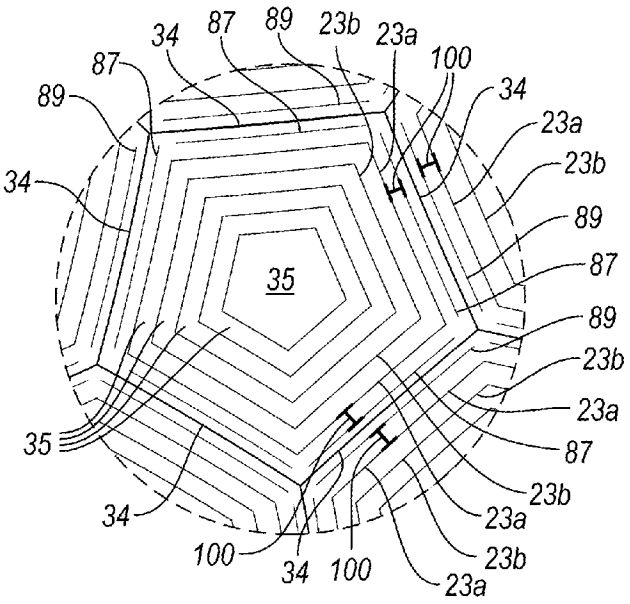
FIG. 7 is an enlarged view of a portion of the example inflatable sports ball shown in FIG. 6.
Figure 6:
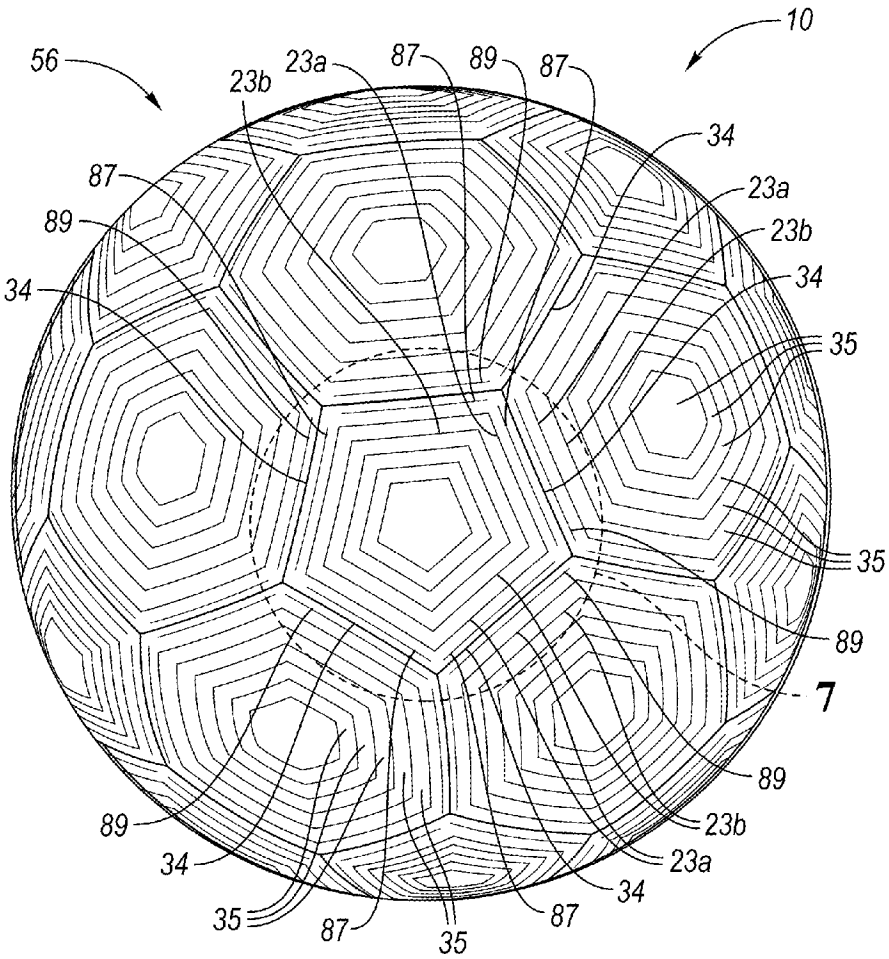
FIG. 6 is a schematic perspective view of another example inflatable sports ball, wherein the cover includes a plurality of indentations, and a plurality of protrusions, which cooperate to define a topographical design on the exterior surface of the inflatable sports ball.

In another example, shown in FIGS. 6-7, the protrusions 23 comprise closed polygonal shapes. More particularly, the first protrusion 23*a*, formed as a closed polygonal shape, disposed on the first plateau section 35*a* is positioned the predetermined distance 100 from the first boundary 87 of the first indentation 34*a*. The second protrusion 23*b*, formed as a closed polygonal shape and positioned on the first plateau section 35*a*, is disposed within an interior of the first protrusion 23*a* in a concentric configuration. In the same way, the first protrusion 23*a*, formed as a closed polygonal shape, disposed on the second plateau section 35*b* is positioned the predetermined distance 100 from the second boundary 89 of the first indentation 34*a* and the first boundary 87 of the second indentation 34*b*. The second protrusion 23*b*, formed as a closed polygonal shape and positioned on the second plateau section 35*b*, is disposed within an interior of the first protrusion 23*a* in a concentric configuration. In such an example, the first protrusions 23*a*, in essence, function as a small tab-like structures projecting from the trailing edge or shoulder portion 29*a*, 29*b* of the respective indentation 34 and function as wickerbill-like features on the ball 10.

As shown in FIGS. 6-7, each plateau section 35 may also include additional protrusions 23, formed as a closed polygonal shape, that are disposed within the interior of the second protrusion 23*b* in a concentric configuration. These additional protrusions 23 allow for enhanced playability of the ball 10 in that these protrusions 23 promote wet traction of the ball 10 with the surface of play, as well as desired grip or contact between a user and/or player's hand or foot and the exterior surface of the ball 10.

As illustrated in the examples shown in FIGS. 3-9 and 12A-12G, the predetermined distance 100 is designed to be a minimal distance. For example, the predetermined distance 100 may be less than about one 1.0 millimeters. In such examples, it is beneficial for the predetermined distance 100 to fall within a particular range, so that, the respective protrusion 23*a*, 23*b* essentially projects outwardly from the trailing edge or shoulder portion 29*a*, 29*b* of the respective indentation 34. In such cases, in flight, the protrusion 23*a*, 23*b* then operates as wickerbill-like feature on the ball 10, to trip the boundary layer of air surrounding the sports ball 10 from laminar to turbulent flow just before the air flows into the respective indentation 34. In essence, the respective protrusion 23*a*, 23*b*, trips the boundary layer of air from laminar flow to turbulent flow at a predetermined point on the ball 10.

The respective protrusion 23*a*, 23*b* positioned the predetermined distance 100 from one of the first boundary 87 and the respective protrusion 23*a*, 23*b* positioned the predetermined distance 100 from the second boundary 89 of an adjacent indentation 34 increases a pressure on the pressure side of the protrusion 23*a*, 23*b*, i.e., the plateau section 35 side, and decreases a pressure on the suction side or indentation 34 side of the protrusion 23*a*, 23*b*. At the same time, a wake of air downstream of the protrusion 23*a*, 23*b*, which contains a pair of counter-rotating vortices, becomes trapped within the respective downstream indentation 34. The presence of the trapped air within the downstream indentation 34 lowers the friction coefficient on the surface of the ball 10, allowing air to flow past the protrusion 23*a*, 23*b* and the trapped air within the indentation 34 while maintaining attachment of the boundary layer of air flow to the exterior surface 13 of the ball 10 all the way to the trailing edge of the indentation 34 side of the protrusion 23*a*, 23*b*.

This forced alteration of the flow of air around the ball 10, e.g., tripping the boundary layer from laminar flow to turbulent flow at a predetermined point on the ball 10, increases lift on the ball 10 and promotes stability and consistency of the ball 10 in flight, which thereby reduces the likelihood of, for example, unwanted dip of the ball 10 during a driven shot on goal by a player toward the end of the driven shot. Ball consistency is one property that is often commented on by players. The most consistent balls are the ones with the optimum combination of amplitude and frequency of the varying force coefficients relative to the amount of spin.

Comparative testing supports that a ball 10 having protrusions 23*a*, 23*b* with a protrusion height 64 greater than 0.05 millimeters and positioned the predetermined distance 100 of less than 1.0 millimeters from a respective boundary 87, 89 of a respective indentation 34, travels more consistently and/or wobbles less in flight than an example ball 10 having the same arrangement of indentations 34 with alternate positioning of the protrusions 23*a*, 23*b*, as well as an example ball 10 having the same arrangement of indentations 34 with no protrusions 23*a*, 23*b*.

Referring again to FIGS. 3-7, in the present disclosure the indentations 34, seams 38, the plateau sections 35, and the protrusions 23 cooperate to define topographical arrangement 56 across a majority of the outer substrate layer 24 of the cover 12. The example topographical arrangements 56 shown in FIGS. 3-7 each promote a balanced design across the exterior surface 13 ball 10. A balanced topographical arrangement 56, avoids uneven lift of the ball 10 and improves consistency of the ball 10 when kicked in any orientation.

As shown in FIGS. 3-5 the topographical design 56 may be composed of a plurality of predefined panel arrangements, wherein a predefined panel arrangement 75 is defined as the orientation of the seams 38, the plateau sections 35, the indentations 34, and the protrusions 23, on each of the respective panels 28. Each predefined panel arrangement 75 may be comprised of a plurality of sub-panel arrangements 73, 77, 79. In the examples shown in FIGS. 3-7, the topographical design 56 is composed of a plurality of panels 28, namely, four panels, each having the same predefined panel arrangement 75. The predefined panel arrangement 75 is composed of three substantially similar sub-panel arrangements 73, 77, 79. Each sub-panel arrangement 73, 77, 79 of the example four panel ball 10 would correspond to a single predefined panel arrangement 75 on a conventional twelve panel 28 ball 10.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the appended claims.

The invention claimed is:

1. An inflatable sports ball comprising:

an interior bladder;

a cover comprising an outer substrate and disposed about the interior bladder, the cover defining:

an outer substrate surface defined by the outer substrate, wherein the outer substrate surface defines a plurality of plateau sections; and a feature surface radially-spaced apart from the outer substrate surface, the feature surface defining:

a plurality of indentations positioned between the plateau sections, wherein each indentation has an indentation terminus disposed on the feature surface and radially spaced apart from the outer substrate surface by an indentation depth and wherein the plurality of indentations comprises a plurality of seams and/or pseudo-seams;

at least one protrusion disposed on a respective plateau section, wherein the at least one protrusion extends radially outward from the outer substrate surface to a protrusion terminus that is radially spaced apart from the outer substrate surface by a protrusion height;

wherein the outer substrate comprises 12 or fewer of panels and/or sub-panels, with each panel or sub-panel being separated from an adjacent panel or sub-panel by one of the plurality of seams or pseudo-seams;

wherein the at least one protrusion is positioned a predetermined distance from the seam or pseudo-seam and wherein the at least one protrusion extends along and parallel to the seam or pseudo-seam to disrupt a laminar airflow passing across the plateau section prior to the laminar airflow entering the seam or pseudo-seam; and wherein each panel and/or sub-panel is surrounded by and peripherally defined by a plurality of the seams and/or pseuo-seams, and wherein the protrusion extends along each of the plurality of seams and/or pseudo-seams that define the respective panel or sub-panel.

2. The inflatable sports ball of claim 1 wherein the indentation terminus is radially-spaced apart from the outer substrate surface in a first direction and the protrusion terminus is radially-spaced apart from the outer substrate surface in a second direction, such that the outer substrate surface is disposed between the indentation terminus and the protrusion terminus; and wherein the first direction is toward the interior bladder, and the second direction is opposite the first direction.

3. The inflatable sports ball of claim 2 wherein the predetermined distance is less than about 1.0 millimeters.

4. The inflatable sports ball of claim 3 wherein each indentation comprises a first boundary, a second boundary, and an indentation width disposed between the first boundary and the second boundary.

5. The inflatable sports ball of claim 4 wherein the at least one protrusion is disposed the predetermined distance from at least one of the first boundary or the second boundary of the respective indentation.

6. The inflatable sports ball of claim 5 wherein:

the at least one protrusion is a plurality of protrusions;

one of the protrusions is disposed the predetermined distance from the first boundary of each indentation; and another one of the protrusions is disposed the predetermined distance from the second boundary of each indentation.

7. The inflatable sports ball of claim 6 wherein the plurality of plateau sections, the plurality of indentations, and the plurality of protrusions cooperate to define a topographical arrangement upon the cover.

8. The inflatable sports ball of claim 7 wherein the plurality of indentations and the plurality of plateau sections define a surface profile that includes an alternating and repeating series of plateau sections and indentations.

9. The inflatable sports ball of claim 8 wherein:

the plurality of plateau sections includes a first plateau section and a second plateau section;

the plurality of indentations includes a first indentation positioned between the first plateau section and the second plateau section; and each of the first plateau section and the second plateau section have a first protrusion and a second protrusion disposed thereon.

10. The inflatable sports ball of claim 9 wherein:

the first boundary of the first indentation is adjacent to the first plateau section;

the second boundary of the first indentation is adjacent to the second plateau section; and the plurality of indentations further includes a second indentation, wherein the first boundary of the second indentation is adjacent to the second plateau section.

11. The inflatable sports ball of claim 10 wherein:

the second protrusion disposed on the first plateau section is disposed the predetermined distance from the first boundary of the first indentation;

the first protrusion disposed on the second plateau section is disposed the predetermined distance from the second boundary of the first indentation; and the second protrusion disposed on the second plateau section is disposed the predetermined distance from the first boundary of the second indentation.

12. The inflatable sports ball of claim 9 wherein the first protrusion comprises a first closed polygonal shape having an interior and the second protrusion comprises a second closed polygonal shape, and wherein the second closed polygonal shape is disposed within the interior of the first closed polygonal shape.

13. The inflatable sports ball of claim 12 wherein:

the first closed polygonal shape and second closed polygonal shape disposed on the first plateau section are positioned on the first plateau section as concentric closed polygonal shapes;

the first closed polygonal shape and second closed polygonal shape disposed on the second plateau section are positioned on the second plateau section as concentric closed polygonal shapes;

the first closed polygonal shape disposed on the first plateau section is positioned the predetermined distance from the first boundary of the first indentation; and the first closed polygonal shape disposed on the second plateau section is positioned the predetermined distance from the second boundary of the first indentation.

14. The inflatable sports ball of claim 13 wherein:

the plurality of indentations further includes a second indentation;

the second indentation is disposed adjacent to the second plateau section; and the first polygonal shape disposed on the second plateau section is positioned the predetermined distance from the first boundary of the second indentation.

15. The inflatable sports ball of claim 1 wherein each protrusion is comprised of a plurality of layers of dimensional ink.

16. The inflatable sports ball of claim 1 wherein:

the protrusion height that is greater than about 0.05 millimeters (mm); and the indentation depth is greater than about 0.5 millimeters (mm).

17. The inflatable sports ball of claim 16 wherein:

the protrusion height is from about 0.07 to about 0.15 millimeters (mm); and the indentation depth is from about 0.5 millimeters to about 1.0 millimeters.

18. The inflatable sports ball of claim 1, wherein the plurality of indentations further comprises at least one indentation on the panel that is interior to the plurality of seams and/or pseudo-seams that peripherally define the respective panel or sub-panel.

* * * * *